US011180167B2

(12) United States Patent
Deng et al.

(10) Patent No.: US 11,180,167 B2
(45) Date of Patent: Nov. 23, 2021

(54) DOUBLE-DECKER RAIL VEHICLE

(71) Applicant: CRRC QINGDAO SIFANG CO., LTD., Shandong (CN)

(72) Inventors: Xiaojun Deng, Shandong (CN); Peng Lin, Shandong (CN); Liangkui Jiang, Shandong (CN); Li Dong, Shandong (CN); Huaxin Hu, Shandong (CN); Qingjing Dong, Shandong (CN); Lan Lin, Shandong (CN)

(73) Assignee: CRRC QINGDAO SIFANG CO., LTD., Shandong (CN)

( * ) Notice: Subject to any disclaimer, the term of this patent is extended or adjusted under 35 U.S.C. 154(b) by 361 days.

(21) Appl. No.: 16/327,855

(22) PCT Filed: Aug. 26, 2017

(86) PCT No.: PCT/CN2017/099196

§ 371 (c)(1),
(2) Date: Feb. 25, 2019

(87) PCT Pub. No.: WO2018/041053

PCT Pub. Date: Mar. 8, 2018

(65) Prior Publication Data

US 2019/0217874 A1 Jul. 18, 2019

(30) Foreign Application Priority Data

Aug. 28, 2016 (CN) ..... 201610737612.8
Aug. 28, 2016 (CN) ..... 201610739981.0
Aug. 28, 2016 (CN) ..... 201610740912.1

(51) Int. Cl.
*B61D 19/00* (2006.01)
*B61D 3/02* (2006.01)
(Continued)

(52) U.S. Cl.
CPC ..... *B61D 19/004* (2013.01); *B61B 1/005* (2013.01); *B61D 1/02* (2013.01); *B61D 1/04* (2013.01);
(Continued)

(58) Field of Classification Search
CPC ... B61D 1/06; B61D 3/02; B61D 1/08; B61D 19/00; B61D 19/004; B61D 19/02;
(Continued)

(56) References Cited

U.S. PATENT DOCUMENTS 2,462,027 A * 2/1949 Murphy ..... B61D 1/08 105/315
2,485,078 A * 10/1949 Watter ..... B61D 1/08 105/315
(Continued)

FOREIGN PATENT DOCUMENTS

CH 679296 A5 1/1992
CN 201646431 U 11/2010
(Continued)

OTHER PUBLICATIONS

First Office Action dated Feb. 10, 2020 for Japanese patent application No. 2019-511371, English translation provided by Global Dossier.
(Continued)

*Primary Examiner* — Zachary L Kuhfuss
*Assistant Examiner* — Cheng Lin
(74) *Attorney, Agent, or Firm* — Yue (Robert) Xu; Apex Attorneys at Law, LLP

(57) ABSTRACT

A double-track vehicle, comprising upper and lower carriages, which are respectively a passenger carriage (1) for providing passenger seats and a cargo carriage (2) for placing cargo, the passenger carriage (1) and the cargo carriage (2) being respectively provided with a passenger
(Continued)

door (3) for passengers to get on and off and a cargo door (4) for loading and unloading cargo. The vehicle carries out simultaneous transport of passengers and cargo, allowing for the function of the rail vehicle to no longer be singular and largely reducing transport and maintenance costs. At the same time, passenger transport and cargo transport are divided into two layers, which completely separates cargo transport and passenger transport, thereby providing passengers with a comfortable seating environment and improving seating safety.

16 Claims, 7 Drawing Sheets

(51) Int. Cl.

| | |
|---|---|
| ***B61D 1/04*** | (2006.01) |
| ***B61D 35/00*** | (2006.01) |
| ***B61D 33/00*** | (2006.01) |
| ***B61D 47/00*** | (2006.01) |
| ***B61B 1/00*** | (2006.01) |
| ***B61D 1/08*** | (2006.01) |
| ***B61D 1/02*** | (2006.01) |
| ***B61D 1/06*** | (2006.01) |

(52) U.S. Cl.
CPC ..... *B61D 1/06* (2013.01); *B61D 1/08* (2013.01); *B61D 3/02* (2013.01); *B61D 19/00* (2013.01); *B61D 19/007* (2013.01); *B61D 19/008* (2013.01); *B61D 33/0007* (2013.01); *B61D 33/0021* (2013.01); *B61D 35/002* (2013.01); *B61D 47/00* (2013.01)

(58) Field of Classification Search
CPC ..... B61D 33/00; B61D 33/0007; B61D 33/0057; B61D 47/00; B61D 49/00; B61D 19/003; B61D 19/001; B61D 19/007; B61D 19/005; B61D 19/006; B61D 19/008
USPC ..... 105/340; 104/30
See application file for complete search history.

(56) References Cited

U.S. PATENT DOCUMENTS

| | | | | | |
|---|---|---|---|---|---|
| 2,632,408 | A * | 3/1953 | Giles | B64D 11/0641 | 105/344 |
| 2,760,442 | A * | 8/1956 | Murphy | B61D 1/06 | 105/315 |
| 3,557,712 | A * | 1/1971 | Milenkovic | B61F 3/12 | 410/4 |
| 4,084,516 | A * | 4/1978 | Ravani | B61D 17/06 | 105/378 |
| 4,240,356 | A * | 12/1980 | Nagy | B61D 1/00 | 105/315 |
| 5,577,358 | A | 11/1996 | Franke | | |
| 6,604,471 | B1 * | 8/2003 | Tarver, Jr. | B61D 31/00 | 108/35 |
| 7,213,882 | B2 * | 5/2007 | Dryburgh | A47C 1/0352 | 297/354.13 |
| 7,517,010 | B2 * | 4/2009 | Saint-Jalmes | B64D 11/0641 | 297/118 |
| 8,720,821 | B2 * | 5/2014 | Ferry | B64D 11/064 | 244/118.6 |
| 2005/0001097 | A1 | 1/2005 | Saint-Jalmes | | |
| 2008/0190318 | A1 | 8/2008 | Palais et al. | | |
| 2010/0252680 | A1 | 10/2010 | Porter | | |
| 2012/0292957 | A1 | 11/2012 | Vergnaud et al. | | |
| 2014/0159440 | A1 | 6/2014 | Porter | | |
| 2018/0281822 | A1 | 10/2018 | Cardin et al. | | |

FOREIGN PATENT DOCUMENTS

| | | | | | |
|---|---|---|---|---|---|
| CN | 102361795 | A | | 2/2012 | |
| CN | 103171563 | A | * | 6/2013 | B65G 63/004 |
| CN | 103171563 | A | | 6/2013 | |
| CN | 104973082 | A | | 10/2015 | |
| CN | 205971308 | U | | 2/2017 | |
| CN | 206049671 | U | | 3/2017 | |
| CN | 206049674 | U | | 3/2017 | |
| DE | 4120590 | A1 | | 12/1992 | |
| DE | 19629301 | A1 | | 1/1998 | |
| EP | 0544473 | A1 | | 6/1993 | |
| EP | 0708018 | A1 | | 4/1996 | |
| EP | 0612296 | B1 | | 12/1996 | |
| EP | 1792829 | A1 | * | 6/2007 | B65G 63/004 |
| EP | 1792829 | A1 | | 6/2007 | |
| JP | 41-4070 | B | | 3/1966 | |
| JP | S58120359 | U | | 8/1983 | |
| JP | S61263866 | A | | 11/1986 | |
| JP | H05139299 | A | | 6/1993 | |
| JP | 2000313362 | A | | 11/2000 | |
| JP | 2008195383 | A | | 8/2008 | |
| JP | 2010095156 | A | | 4/2010 | |
| JP | 2015174507 | A | | 10/2015 | |
| KR | 20140048597 | A | | 4/2014 | |
| RU | 20894 | U1 | | 12/2001 | |
| WO | 2015121506 | A2 | | 8/2015 | |
| WO | WO-2015121506 | A2 | * | 8/2015 | B61D 47/00 |

OTHER PUBLICATIONS

Search Report dated Mar. 17, 2020 for European patent application No. 17845355.1.
Second Office Action dated Sep. 10, 2020 for Japanese patent application No. 2019-511371, English translation provided by Global Dossier.
First Office Action dated Dec. 3, 2019 for Russian patent application No. 2019108462, 7 pages, with English translation.
International Search Report for PCT/CN2017/099196 dated Dec. 6, 2017, ISA/CN.

* cited by examiner

DOUBLE-DECKER RAIL VEHICLE

The present application is the national phase of International Application No. PCT/CN2017/099196, titled "DOUBLE-DECKER RAIL VEHICLE", filed on Aug. 26, 2017, which claims the benefit of priorities to Chinese patent applications No. 201610740912.1, titled "DOUBLE-DECKER RAIL VEHICLE", filed with the Chinese State Intellectual Property Office on Aug. 28, 2016, No. 201610739981.0, titled "RAIL VEHICLE", filed with the Chinese State Intellectual Property Office on Aug. 28, 2016, and No. 201610737612.8, titled "RAIL TRANSIT WAGON", filed with the Chinese State Intellectual Property Office on Aug. 28, 2016, the entire disclosures of which applications are incorporated herein by references.

FIELD

The present application relates to a high-speed rail vehicle such as a D-series high speed train and particularly to a double-decker rail vehicle, and pertains to the technical field of interior equipment of rail vehicle.

BACKGROUND

With the rapid development of high-speed rail vehicles, the requirements for functionality of the vehicles are becoming increasingly high. The existing rail vehicles have a single function, the D-series high speed trains can only transport passengers, and freight trains can only transport cargoes, which greatly increases the transportation cost and maintenance cost, including the cost of constructing the corresponding passenger railways, freight railways, passenger platforms and freight platforms, etc. In addition, with the development of high-speed rail vehicles, the requirements for interior equipment of the carriages are getting higher and higher to improve the class of the carriages and meet the individual needs of high-end passengers.

SUMMARY

The main technical problem to be solved by the present application is to provide a double-decker rail vehicle which can improve the function of the rail vehicle and realize simultaneous transportation of cargoes and passengers.

To achieve the above object, the first technical solution of the present application is as follows:

A double-decker rail vehicle includes two upper and lower compartments, which are a passenger compartment for passengers to ride and a cargo compartment for placing goods, respectively. The passenger compartment is provided with a passenger door for passengers to get on and off and the cargo compartment is provided with a cargo door for loading and unloading cargoes.

Furthermore, an auxiliary cargo area for storing cargo is arranged in the passenger compartment, and an auxiliary passenger area for passengers to use is arranged in the cargo compartment.

Furthermore, the upper compartment is the passenger compartment, and the lower compartment is the cargo compartment.

Furthermore, the passenger compartment is provided with two rows of seat units arranged in a length direction of the vehicle body, and two front and rear seat units are staggered and overlapped in the length direction of the vehicle body. The seat unit includes a seat, and the seat is tilted toward a side wall on a side where the seat is located.

Furthermore, each of the seat units is partitioned by a seat partition wall, and the seat partition wall is composed of a transverse partition wall and a longitudinal partition wall, wherein the transverse partition wall is S-shaped, and the seat develops in a space where an outer side of the transverse partition wall of the present seat unit is outwardly recessed and in a space where an inner side of the transverse partition wall of the front seat unit is inwardly recessed.

Furthermore, a partition wall door is arranged on the longitudinal partition wall, the partition wall door is a sliding door, the longitudinal partition wall is of a hollow structure, and the partition wall door in an open state is concealed inside the longitudinal partition wall.

Furthermore, each of the seat units is provided with the seat, a footrest, a table and a functional chair. The seat includes a backrest, a seat cushion and a movement mechanism, and the movement mechanism drives the backrest and the seat cushion to move, so that the seat can be switched between a sitting position, a lying position and any reclining position. The footrest is mounted exactly in front of the seat, and when the seat is in the lying position, the footrest, the seat cushion and the backrest together forms a horizontal sleeper. The table and the functional chair are mounted on a side portion of the seat facing the side wall.

Furthermore, a set of windows is arranged on the vehicle body corresponding to each of the seat units.

Furthermore, the passenger compartment includes a plurality of sub-compartments partitioned by compartment partition walls. The compartment partition wall is provided with a compartment door, and each of the sub-compartments has a rest area and a lavatory.

Furthermore, a sitting and lying dual-purpose device is mounted in the rest area, the lavatory is separated from the rest area by a partition, and a lavatory door is provided on the partition.

Furthermore, the sitting and lying dual-purpose device at least includes a set of sofa capable of shifting between a sitting position and a lying position and sofa stool. The sofa in the lying position is combined with the sofa stool to form a horizontal bed.

Furthermore, the compartment partition wall immediately adjacent to an aisle of the compartment is of a wavy structure composed of a plurality of arc-shaped partition walls.

Furthermore, a first window is arranged on the side wall of the vehicle body corresponding to the rest area, and a second window is arranged on the side wall of the vehicle body corresponding to the lavatory.

Furthermore, the cargo compartment has a through cargo space from one head compartment on one side to the other head compartment on the other side, and support structures are provided in the cargo space.

Furthermore, the cargo space is divided into a plurality of sections by the support structures, a part of the sections are equipment compartments, and other part of the sections are cargo holds. Skirt plates of the equipment compartment are arranged on both sides of the equipment compartment, and cargo doors are arranged on both sides of the cargo hold.

Furthermore, the support structure has a hollow bracket structure.

Furthermore, a cargo hold floor is arranged in the cargo hold, and the cargo hold floor is provided with a plurality of rows of ball bearings for moving the cargoes in the cargo hold.

Furthermore, the cargo doors are folding doors.

Furthermore, the folding door includes an upper page and a lower page. The upper page is hinged with the lower page, and a top of the upper page is hinged with a frame of the vehicle body. A door support mechanism for supporting the folding door is mounted between the folding door and the support structure.

Furthermore, two upper and lower platforms are arranged corresponding to the passenger compartment and the cargo compartment, and the platforms respectively are a passenger platform and a freight platform.

In summary, the double-decker vehicle according to the present application realizes simultaneous transportation of passengers and cargoes, so that the functions of the rail vehicle are no longer single, and the transportation cost and maintenance cost are greatly reduced. At the same time, passenger transport and cargo transport are separated into two decks, which completely separates cargo transport from passenger transport, thereby providing passengers with a comfortable riding environment and improving the riding safety.

The present invention is applicable for long-distance intercontinental trains that travel between countries.

Figure 1:
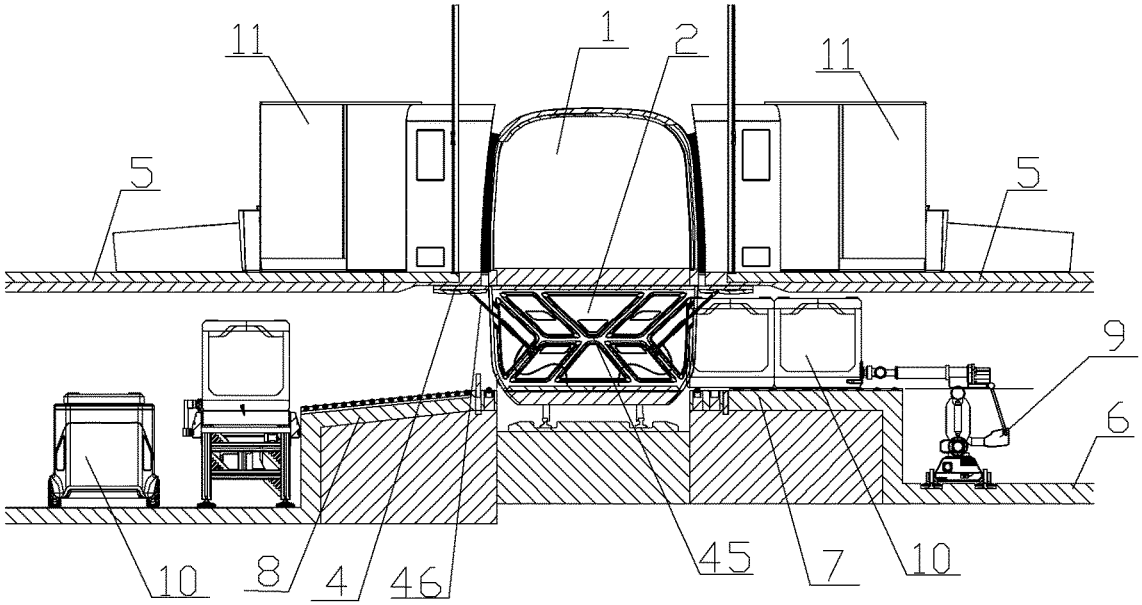
FIG. 1 is a schematic diagram showing the structure of a double-decker rail vehicle and platforms according to the present application.

REFERENCE NUMERALS IN FIGS. 1 TO 12 passenger compartment 1, cargo compartment 2, equipment compartment 2*a*, cargo hold 2*b*, passenger door 3, cargo door 4, passenger platform 5, freight platform 6, cargo-loading passage 7, cargo-unloading passage 8, handling device 9, container 10, connection passage 11, seat unit 12, compartment aisle 13, seat partition wall 14, transverse partition wall 14*a*, longitudinal partition wall 14*b*, side wall of vehicle body 15, seat 16, footrest 17, table 18, functional chair 19, wall light 20, guest room window 21, television set 22, partition wall door 23, compartment partition wall 24, sub-compartment 25, compartment door 26, rest area 27, lavatory 28, partition 29, two-seater sofa 30, sofa stool 31, shelf 32, sink 33, toilet bowl 34, bathtub 35, first window 36, second window 37, passing platform 38, compartment end door 39, aisle 40, wash basin 41, lavatory 42, leisure area 43, power distribution cabinet 44, support structure 45, door support mechanism 46, waiting area 47, sightseeing compartment 48, bar compartment 49, bar table 50, bar chair 51, wine cabinet 52, side window 53, staircase 54, head compartment door 55, partition 56, sightseeing seat 57, compartment aisle 58, backrest 59, seat cushion 60, base 61, footrest 62, support plate 63, panel 64, lay-up table 65, sunroof 66, sightseeing window 67, cab 68, head compartment 69, folding door 70, ball 71, lift positioning structure 72.

DETAILED DESCRIPTION OF EMBODIMENTS

The present application is further described in detail hereinafter in conjunction with the drawings and embodiments:

First Embodiment

Figure 2:
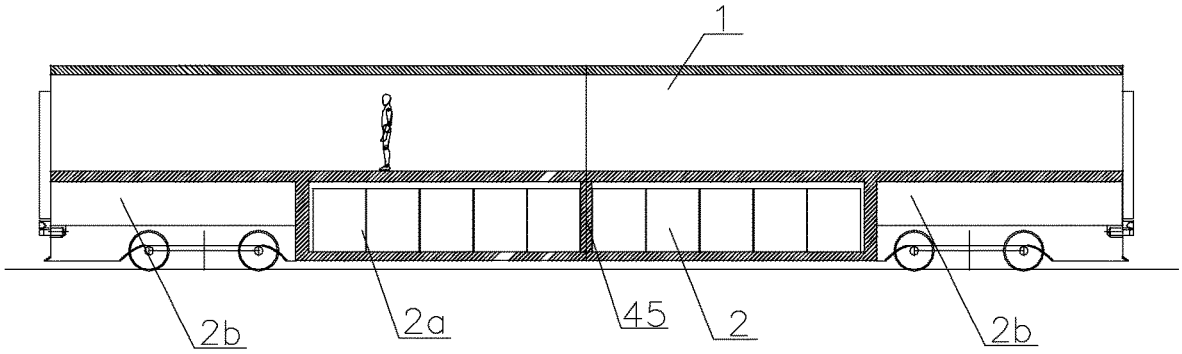
FIG. 2 is a schematic diagram showing the structure of the double-decker rail vehicle according to the present application.

As shown in FIG. 1 and FIG. 2, a double-decker rail vehicle is provided according to the present application, and includes two cabs at both ends, head compartments immediately adjacent to the cabs, and multiple middle compartments. The double-decker rail vehicle in this embodiment refers to the middle compartment.

The middle compartment includes an upper passenger compartment 1 for passengers to ride and a lower cargo compartment 2 for placing cargoes. The passenger compartment 1 and the cargo compartment 2 are respectively provided with a passenger door 3 for passengers to get on and off and a cargo door 4 for loading and unloading cargoes. The passenger compartment 1 includes business-class compartments, first-class compartments and second-class compartments so as to meet the riding needs of passengers of different levels.

As shown in FIG. 1, two platforms which are on an upper deck and a lower deck are arranged corresponding to the passenger compartment 1 and the cargo compartment 2, on the upper deck is a passenger platform 5 and on the lower deck is a freight platform 6.

The freight platform 6 is provided with freight passages, which include a cargo-loading passage 7 arranged on one side of the vehicle, a cargo-unloading passage 8 arranged on the other side of the vehicle, and a handling device 9 for pushing the cargo into the vehicle from one side of the vehicle and pushing the cargo out from the other side of the vehicle. The cargo-loading passage 7 includes a cargo-loading conveyor belt which is flush with the vehicle floor and arranged in the length direction of the vehicle. The cargo-loading conveyor belt includes a plurality of sections of transverse cargo-loading conveyor belts conveying cargoes in the length direction of the vehicle and a plurality of sections of free cargo-loading conveyor belts arranged at the cargo door 4 of the vehicle to achieve a random-direction delivery of cargo. The cargo-unloading passage 8 includes a plurality of sections of longitudinal cargo-unloading conveyor belts obliquely arranged and conveying cargoes in a width direction of the vehicle, and a transverse cargo-unloading conveyor belt arranged in the length direction of the vehicle and at an end of the longitudinal cargo-unloading conveyor belt away from the vehicle. The handling device 9 may be a robot.

The cargoes to be transported are respectively placed in containers 10, and large baggage of passengers can also be placed in the containers 10. Each container 10 is provided with a chip for automatic identification of the cargo, and the chip stores names, loading and unloading locations, placement information, cargo owner information of the cargo in the container 10, etc. Automatic handling of the cargo is realized by the robot.

The passenger platform 5 is provided with a connection passage 11, one end of the connection passage 11 is connected with a waiting area 47, and the other end is connected with the passenger door 3 of the passenger compartment 1. Passengers can get on or off the vehicle directly via the dedicated connection passage 11, and train platforms in the conventional technology are no longer needed. Passengers no longer need to enter platforms first via the waiting area 47, and then to get on the vehicle via the platforms, thereby shortening the time for passengers to get on and off the vehicle, improving the safety of getting on and off the vehicle, improving comfort of passengers when getting on and off the vehicle, and meeting more humanized needs of the passengers. The connection passage 11 has a telescopic structure which extends out when the vehicle enters the station, so that one end is closely attached to the passenger door 3, and the waiting area 47 is in communication with the passenger door 3. After passengers get on and off the vehicle, the connection passage can be retracted without affecting other functions of the station.

The vehicle simultaneously transports passengers and cargoes, thus allowing the function of the rail vehicle to be no longer single and greatly reducing transport and maintenance costs. At the same time, transportation of passengers and cargoes is separated into two decks, thus the cargo transport and passenger transport are completely separated without affecting each other, which not only can greatly shorten the stopping time at each station, but also can ensure the safety of passengers when passengers get on and off the vehicle, thereby providing passengers with a more comfortable riding environment.

A Second Embodiment

Figure 3:
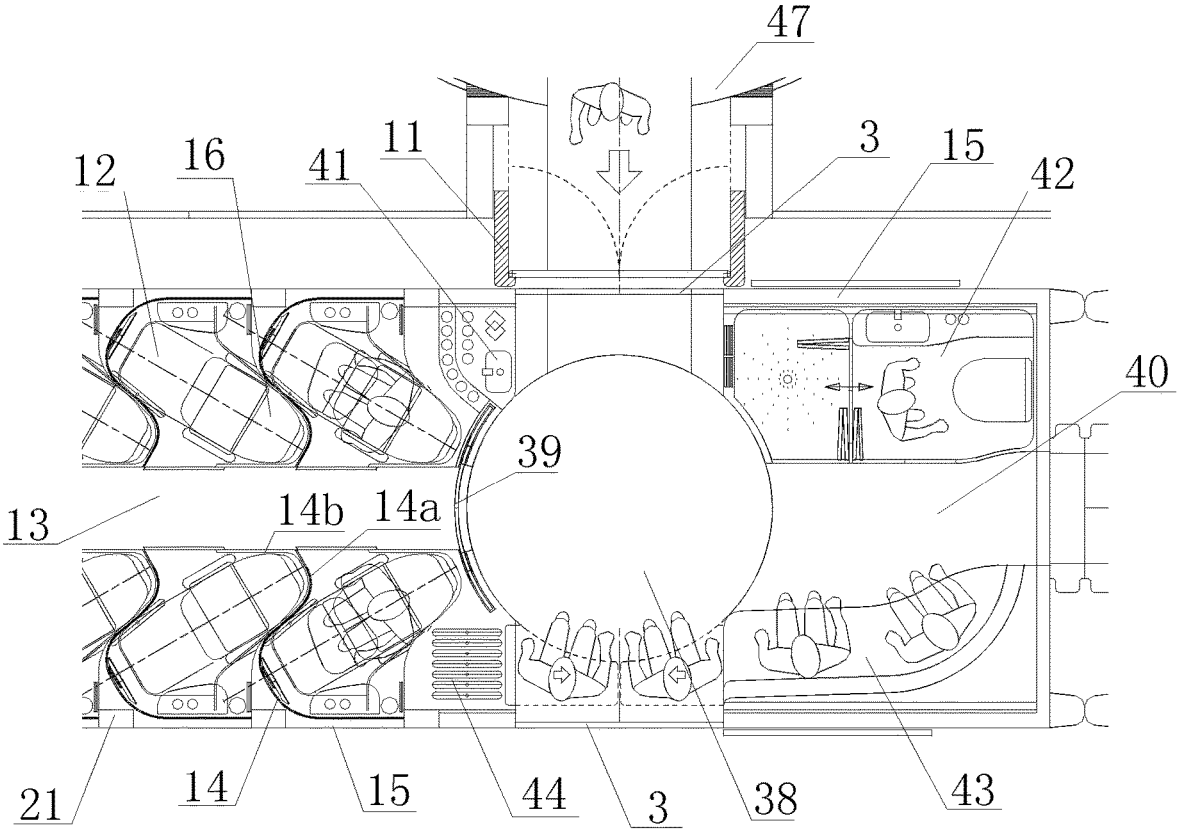
FIG. 3 is a layout diagram of a first-class passenger compartment according to the present application.
Figure 4:
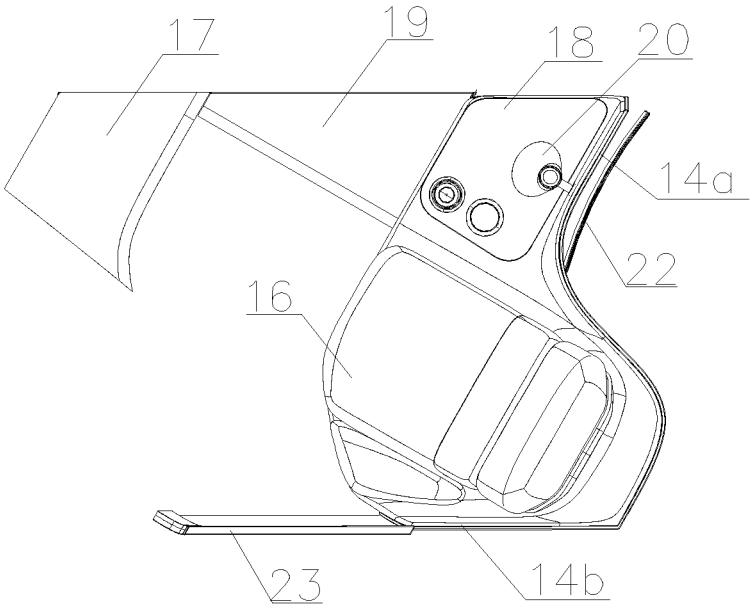
FIG. 4 is a schematic diagram showing the structure of a seat unit (in sitting position state) of the first-class passenger compartment according to the present application.
Figure 5:
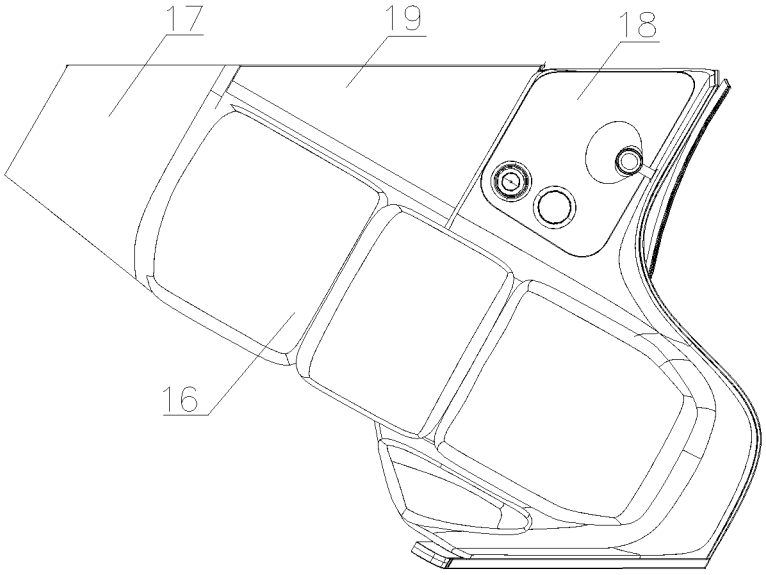
FIG. 5 is a schematic diagram showing the structure of the seat unit (in lying position state) of the first-class passenger compartment according to the present application.

In the present embodiment, the passenger compartment 1 refers to the first-class compartment. As shown in FIGS. 3 to 5, the compartment includes two rows of seat units 12 arranged in the length direction of the vehicle body. Between the two front and rear seat units 12 is a compartment aisle 13. Two front and rear seat units 12 are staggered and overlapped in the length direction of the vehicle body to reduce space occupied by each of the seat units, which greatly increases the number of passengers in the compartment while ensuring the comfort of passengers, thereby maximally utilizing the space of the compartment.

Each of the seat units 12 is separated via a seat partition wall 14. The seat partition wall 14 is a half-height partition wall, which not only ensures the comfort of riding, but also provides each seat unit 12 with excellent privacy. Material of the seat partition wall 14 is composed of an outer layer of wood composite board, and a middle layer of sponge and an inner layer of decorative cloth, wherein the decorative cloth may be a linen material with a good appearance and a good hand feeling. The outermost layer of the wood composite board (that is, an outer surface of the seat partition wall 14) has a decorative board, such as a decorative board having a wood grain surface. The decorative board may also be a glass board, which not only can ensure the overall structural strength of the seat partition wall 14, but also can improve the overall aesthetics of the seat partition wall 14.

The seat partition wall 14 has an L-shaped structure composed of a transverse partition wall 14*a* and a longitudinal partition wall 14*b*, wherein the transverse partition wall 14*a* is S-shaped, an inner side of the transverse partition wall 14*a* (that is, a side immediately adjacent to the side wall 15 of the vehicle body) is recessed toward interior of the seat unit 12, and an outer side of the transverse partition wall 14*a* (that is, a side immediately adjacent to the compartment aisle 13) is recessed toward external of the seat unit 12. The transverse partition wall 14*a* is fixedly connected to the longitudinal partition wall 14*b* via a connecting member, bottoms of the transverse partition wall 14*a* and the longitudinal partition wall 14*b* are fixedly connected to the floor of the compartment, and one side of the transverse partition wall 14*a* is fixedly connected to the side wall 15 of the vehicle body.

Each of the seat units 12 includes a seat 16, a footrest 17, a table 18, and a functional chair 19. Each seat 16 is tilted toward the side wall 15 of the vehicle body on a side where the seat is located, that is, tilted relative to a movement direction of the vehicle, and preferably is tilted at an angle of 45 degrees. The seat 16 extends in a space where the outer side of the transverse partition wall 14*a* of the present seat unit 12 is outwardly recessed and in a space where an inner side of the transverse partition wall 14*a* of the front seat unit 12 is inwardly recessed, thereby maximally saving the space occupied by each seat unit 12 and improving utilization rate of the space inside the compartment.

The seat 16 includes a backrest, a seat cushion and a movement mechanism. The backrest and the seat cushion are both composed of a frame, a sponge pad and an outermost decorative cloth. The backrest is hinged to the seat cushion, and the movement mechanism drives the backrest and the seat cushion to switch between a sitting position and a lying position. Passengers can switch the seat 16 between the sitting position, the lying position and any reclining position by operating a switch to meet different needs of passengers.

The footrest 17 is fixed below the inner side of the transverse partition wall 14*a* of the front seat unit 12. Similar to the seat cushion, the footrest 17 is composed of a frame, a sponge pad and an outermost decorative cloth, and the frame of the footrest 17 is fixed to the transverse partition wall 14*a* by bolts. As shown in FIG. 5, when the seat 16 is in the lying position, the seat 16 extends forward to the footrest 17, and the footrest 17, the seat cushion and the backrest of the seat 16 together form a horizontal sleeper, which not only can save space, but also can ensure that passengers are more comfortable while resting on the sleeper.

The table 18 is arranged between the other side of the seat 16 and the side wall 15 of the vehicle body. In the present embodiment, the table 18 is formed by a plane formed by a lower portion of the transverse partition wall 14*a* being recessed forward. A side portion of the table 18 closely abuts against the side wall 15 of the vehicle body, and the table 18 is integrated with the transverse partition wall 14*a*, which not only simplifies the structure of the seat unit 12 and facilitates a modular assembly of the seat unit 12, but also ensures the overall aesthetics of the transverse partition wall 14*a*. In order to ensure flatness of a surface of the table 18, the sponge layer and the linen layer in the seat partition wall 14 are not provided on an upper surface of the table 18; instead, a decorative board is directly attached to the wood composite board, and parts such as a cup holder are provided on the decorative board of the table 18 for passengers to use. Since the table has a large area, books, magazines, etc. can also be placed thereon. A wall light 20 is further mounted on the transverse partition wall 14*a* above the table 18, and the passengers can control the light according to their own needs. The footrest 17 of the rear seat unit 12 is arranged in the space where the transverse partition wall 14*a* is forwardly recessed, that is, arranged below the table 18 of the front seat unit 12, so as to fully utilize the recessed space below the table 18. Besides, there is still space below the footrest 17 to allow passengers to place items such as shoes conveniently.

The movable functional chair 19 is further independently mounted in front of the table 18. The functional chair 19 is located below a windowsill of the window 21 on the side wall 15 of the vehicle body, and the functional chair 19 as a whole has a triangular prism structure, which realizes a smooth transition of the space between the table 18 and the side wall 15 of the vehicle body, and reasonably utilizes the space therein. In the present embodiment, the functional chair 19 is directly placed on the floor of the passenger compartment, and the passenger can move the functional chair 19 to a desired position and angle as needed. The functional chair 19 can be used by passengers, who temporarily come to the seat unit 12, to sit thereon and to chat with others in the seat unit 12 conveniently.

Below a seat surface of the functional chair 19 is a storage space, and the storage space may be in the form of a storage locker or a storage drawer. The passenger can place small items and valuables carried around into the storage locker or the storage drawer. The storage locker or storage drawer may be provided with a cipher lock to ensure the safety of items of the passengers.

In order to improve the comfort of riding, a television set 22 is arranged in each of the seat units 12, and is mounted on the transverse partition wall 14*a* of the front seat unit 12.

A set of windows 21 is arranged on the side wall 15 of the vehicle body corresponding to each of the seat units 12. The windows of all the seat units 12 are independent of each other, and activities of the passengers in one seat unit 12 may not be reflected by window glass onto the window 21 of another adjacent seat unit 12, so that the privacy of each seat unit 12 can be further improved.

In the present embodiment, each set of windows 21 continuously extends from the side wall to a roof panel of the vehicle. The window 21 is arranged between the table 18 and the transverse partition wall 14*a* of the front seat unit 12, and has an overall shape, which is thin and has an upper portion with an arc-shaped surface, being the same as the shape of the vehicle body. The window 21 of such structure increases an area of the window 21 corresponding to each seat unit 12 and an overall height of the window 21, thereby greatly enlarging the window view, improving the visual effect and providing passengers with the best view and user experience. Through the window 21 extending from the side wall 15 of the vehicle body to a side top, the passenger sitting on the seat 16 tilted toward the window 21 can get a more perfect outside scenery, and may get less feeling of motion sickness to some extent.

A partition wall door 23 is arranged between the longitudinal partition walls 14*b* of two seat units 12 at front and rear for closing a passage gap between the two adjacent seat units 12 to further improve the privacy of each seat unit 12. In the present embodiment, the partition wall door 23 is a sliding door, and the longitudinal partition wall 14*b* is of a hollow structure. When being in an open state, the partition wall door 23 is concealed inside the longitudinal partition wall 14*b*, and is integrated with the longitudinal partition wall 14*b* to save the space occupied by the partition wall door 23. When being in a closed state, the partition door 23 protrudes out from the inside of the longitudinal partition wall 14*b*.

A decorative light and a number light (not shown) are arranged on an outer side surface of each of the longitudinal partition walls 14*b*, and decorative lights and number lights may also be arranged on an outer surface of the partition wall door 23. The number light helps passengers to find their own seat units 12 as soon as possible. Multiple decorative lights are arranged on the seat partition walls 14 on both sides of the compartment aisle 13, which not only serve as an illumination, but also increase the overall aesthetics of the interior of the compartment.

The decorative light may be a light belt composed of multiple parallel light strips, the light strip may be a horizontal light strip, a vertical light strip, an oblique light strip, an arc-shaped light strip, etc., and the decorative light may also be a special figure or pattern consisting of multiple light strips. In the present embodiment, it is preferable to provide multiple parallel and oblique light strips on the outer surface of the longitudinal partition wall 14*b*, and the plurality of light strips constitute an oblique light belt, which is simple and elegant.

Grooves are arranged at positions, where the decorative light and number light are located, on the wood composite board of the seat partition wall 14 according to a designed figure and pattern, and the grooves have the same shape as the light strips. An LED light source board is mounted inside the groove, and the LED light source board is fixed on the longitudinal partition wall 14*b* by screws. A layer of light transmissive material overlies on the LED light source board, and the light transmissive material is preferably made of acrylic material. The light transmissive material is fixed on the longitudinal partition wall 14*b* by glue, and is flush with the surface of the longitudinal partition wall 14*b*, thus flattening the entire surface of the longitudinal partition wall 14*b* and ensuring the overall aesthetics of the longitudinal partition wall 14*b*. When the LED light source board is on, the light emitted by the LED light source board is transmitted through the light transmissive material, and the light strips of different shapes or other special figures and patterns are displayed while being illuminated.

The decorative light and the number light may also be of another structure, that is, grooves with an area which may cover the complete shape and pattern are arranged at the positions of the decorative light and the number light on the wood composite board of the longitudinal partition 14*b*. Multiple LED light source boards are mounted inside the grooves, the LED light source boards are fixed on the longitudinal partition wall 14*b* by screws, a light transmissive material overlies the LED light source boards, and a light shielding sheet overlies a surface of the light transmissive material. The light shielding sheet is fixed on the light transmissive material by glue, and is provided with openings according to the designed figure and pattern. The light transmitted through the openings can form desired shapes and patterns.

In the first-class compartment, each of the seat partition walls 14 on both sides of the compartment aisle 13 is provided with a light belt, and each of the seat units 12 is further provided with the wall light 20. In the present embodiment, a roof light belt (not shown) is arranged in a central area of the roof of the compartment in the length direction of the compartment, and a plurality of cylindrical roof lights are arranged on both sides of the roof light belt.

The roof light is composed of a cylindrical lightshade and an LED light internally mounted, and the lightshade is fixed on the roof panel, which simplifies the structure of the roof panel of the compartment and increases the overall aesthetics of the compartment interior while improving the illumination effect.

The seat unit 12 in the present application can be modularly assembled. The seat 16, the footrest 17, the table 18, the functional chair 19, the wall light 20, the seat partition wall 14, the partition wall door 23, the television set 22, the decorative lights, the number lights, etc. can all be pre-assembled before on board, and only need to be fixedly connected to the floor and side wall after boarding, which greatly improves the assembly efficiency of the existing vehicle and reduces the labor intensity.

The Third Embodiment

Figure 6:
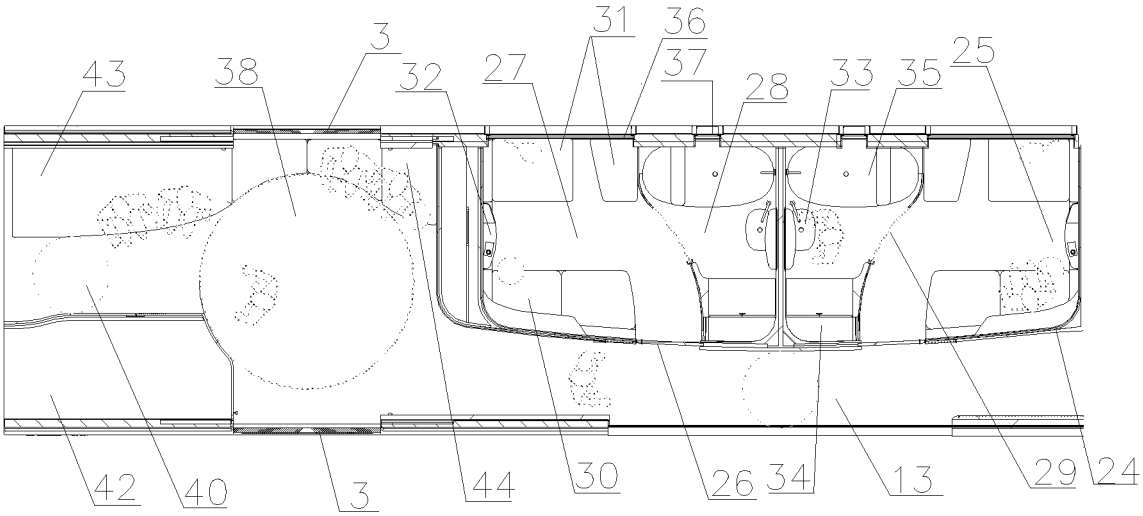
FIG. 6 is a layout diagram of a business-class passenger compartment according to the present application.
Figure 7:
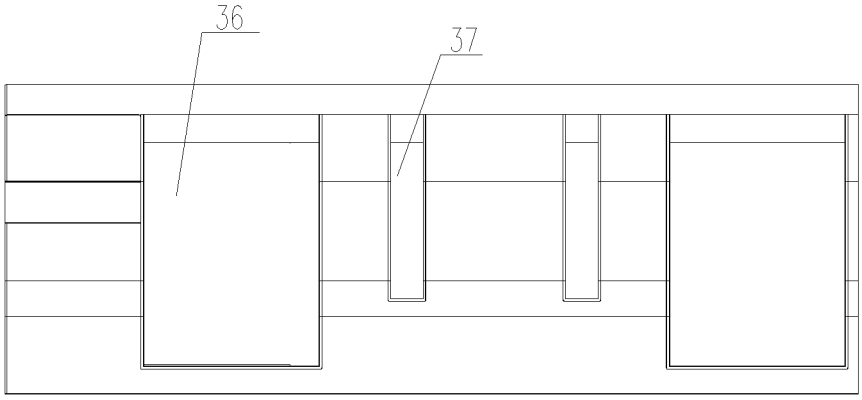
FIG. 7 is a layout diagram of windows in the business-class passenger compartment according to the present application.

In the present embodiment, the passenger compartment 1 refers to a business-class compartment. As shown in FIG. 6 and FIG. 7, the business-class compartment includes multiple sub-compartments 25 partitioned by compartment partition walls 24. A total of six sub-compartments 25 are arranged in the business-class compartment. A compartment door 26 is arranged on the compartment partition wall 24. The sub-compartments 25 are arranged on one side of the business-class compartment in the length direction of the vehicle body, and the compartment aisle 13 is arranged between the sub-compartments 25 and the side wall 15 of the vehicle body on the other side. The sub-compartments 25 are partitioned by the compartment partition walls 24, and the compartment partition wall 24 has a fully enclosed structure from the floor to the roof panel of the compartment.

There is a rest area 27 and a lavatory 28 in each of the sub-compartments 25. A sitting and lying dual-purpose device is mounted in the rest area 27, the lavatory 28 is separated by a partition 29, and a lavatory door is mounted on the partition 29. The lavatory door has a sliding door structure. The partition 29 extends from one side of the compartment door 26 toward the side wall on the opposite side. The partition 29 is generally arc-shaped, which reasonably divides the space of the rest area 27 and the lavatory 28, and also provides an arc-shaped passage for passengers entering the sub-compartment 25 from the compartment door 26 to enter the rest area 27. The partition 29 may be made of an opaque material or an electric control switchable glass. The light control switchable glass is controlled to be opaque when in use, and is controlled to be transparent when not in use, which has a visual effect of enlarging the space.

Each of the sub-compartments 25 is partitioned by the compartment partition walls 24 into a relatively independent space, which can meet the high requirements of passengers for privacy. Each of the sub-compartments 25 is provided with the sitting and lying dual-purpose device and the lavatory, which can provide passengers with a full range of services. Through a reasonable space layout, the limited space is fully utilized, so that the layout of the devices in the compartment is reasonable and compact, and the devices are more convenient for passengers to use, which meets higher requirements of high-end consumer groups such as VIP on privacy and comfort.

The compartment partition wall 24 immediately adjacent to the compartment aisle 13 has a wavy structure composed of multiple arc-shaped partition walls, and one or two sub-compartments 25 are arranged between two wave troughs at two ends of each of the arc-shaped compartment partition walls 24. In the present embodiment, two compartments are preferably arranged therebetween. The compartment partition wall 24 has an arc-shaped design, and an inwardly recessed space is arranged at a joint of two arc-shaped walls, which relatively expands a passage space in the compartment aisle 13 for the passengers without affecting a usable space in the sub-compartment 25, effectively avoids a crowded state when many people pass through the compartment aisle 13 in a staggered manner, and improves the riding comfort of passengers.

The sitting and lying dual-purpose device is arranged in the rest area 27, and the rest area 27 can provide a sitting and activity space for the passengers during the day, and can be used as a bed at night. The sitting and lying dual-purpose device includes a set of two-seater sofa 30 and two sofa stools 31. The two-seater sofa 30 is arranged on an entrance side of the compartment door 26 close to the compartment partition wall 24, and the two sofa stools 31 are arranged on an opposite side of the two-seater sofa 30 (that is, close to the side wall of the vehicle body).

The two-seater sofa 30 is composed of a backrest, a seat cushion and a transmission mechanism, and the backrest and the seat cushion switch between the sitting position and the lying position through the transmission mechanism. The two sofa stools 31 are movable, and can be moved by the passengers to desired positions. A total width of the two sofa stools 31 corresponds to a width of the two-seater sofa 30. During the day, the backrest of the two-seater sofa 30 is vertical and the seat cushion is retracted to a seat state, and an area for activities of passengers is left between the two-seater sofa 30 and the two sofa stools 31, thus making full use of the limited space of the rest area 27. At night, the seat cushion of the two-seater sofa 30 is driven by the transmission mechanism to move forward, and therewith the backrest is lowered to a horizontal state, and the positions of the two sofa stools 31 are moved, so that the two-seater sofa 30 and the two sofa stools 31 are combined to form a horizontal bed for passengers to rest at night. Each of the sub-compartments 25 can be used by two adults and one or two children, which can fully meet the needs of a family. Depending on the space of the rest area 27, only one set of two-seater sofa 30 may be arranged, and the two-seater sofa 30 can become a bed after being laid flat.

A shelf 32 is arranged between the two-seater sofa 30 and the sofa stool 31, and the shelf 32 is fixed on the compartment partition wall 24 for passengers to place small items for use at any time.

A sink 33, a toilet bowl 34 and a shower device are arranged in the lavatory 28, a rack and a mirror are mounted above the sink 33, and the shower device includes a bathtub 35, a shower head, etc., to meet different use requirements of the passengers. The bathtub 35 is laterally arranged and abuts against the side wall 15 of the vehicle body, the sink 33 is mounted close to the compartment partition wall 24 on a side portion of the sub-compartment 25, the sink 33 is mounted halfway between the bathtub 35 and the toilet bowl 34, and the toilet bowl 34 is mounted between the partition 29 at an entrance of the compartment door 26 and the compartment partition wall 24 on the side portion. The entire lavatory 28 has a reasonable and compact spatial layout, and can achieve a space utilization ratio of 100%.

Two windows are arranged in each of the sub-compartments 25, a first window 36 is arranged on the side wall 15 of the vehicle body corresponding to the rest area 27, and a second window 37 is arranged on the side wall 15 of the vehicle body corresponding to the lavatory 28. The second window 37 is arranged above the bathtub 35. Whether in the rest area 27 or in the lavatory 28, the passenger can always enjoy the scenery outside the window through the first window 36 and the second window 37, which improves the comfort of riding. In order to ensure privacy of the passengers, the first window 36 and the second window 37 both adopt coated glass, so that people outside the window cannot see the activities of the passengers inside the vehicle, and also the passengers can view the scenery outside the vehicle without being affected.

In the present embodiment, the first window 36 and the second window 37 continuously extend from the side wall 15 of the vehicle body to the roof panel of the vehicle body and include a side wall portion and a side roof portion (referring to a transition position between the side wall 15 and the roof panel of the vehicle body). Upper portions of the first window 36 and the second window 37 have an arc shape, which is the same as the side wall and the side roof. The first window 36 has a large area, and a width that is about equal to a width of the rest area 27 at the side wall 15 of the vehicle body, and the second window 37 has a relatively small area, and generally has a shape of elongated strip. Structures of the first window 36 and the second window 37 increase the window area corresponding to each compartment and the overall height of the window while ensuring the overall strength and rigidity of the side wall 15 of the vehicle body, which not only guarantees a lighting effect of the sub-compartment 25, but also greatly increases the window view, thereby improving the visual effect and providing the passenger with the best view and user experience.

In order to meet higher demands of VIP passengers, a projection device is further arranged in the rest area 27. A projection screen of the projection device is mounted at the position of the first window 36, and the passenger can view the projection while sitting on the two-seater sofa 30. When not in use, the projection screen is hidden in a window frame above the first window 36; and when in use, the projection screen overspreads in front of the first window 36, that is, the projection screen can also be used as a curtain.

Decorative lights and room number lights are mounted on an outer surface of the compartment partition wall 24 of the sub-compartment 25. The decorative light and the room number light may both be mounted on the compartment door 26. The room number light is convenient for the passenger to confirm whether the number of the sub-compartment 25 is correct after getting on the vehicle. Structures of the decorative light and the number light are the same as those described in the second embodiment.

The Fourth Embodiment

As shown in FIG. 3 and FIG. 6, a passing platform 38 facing the passenger door 3 is arranged at an end of the compartment, which is a transition area for passengers to temporarily stop after passengers get on the vehicle or before passengers get off the vehicle through the passenger door 3. The passing platform 38 is generally designed to be circular, a compartment end door 39 is arranged on one side of the circular passing platform 38, and the other side of the circular passing platform 38 is connected to another adjacent compartment through an aisle 40. The design of the circular structure of the passing platform 38 at a junction between two compartments relatively increases an area of the passing platform 38 and increases the number of people that can be accommodated by the passing platform 38 while increasing the aesthetics, thereby expanding a space for people passing here, effectively relieving a congestion state when there are many people getting on and off, and further improving the riding comfort of the passengers.

Arc-shaped partition walls are arranged around the circular passing platform 38. The partition walls separate the passing platform from the compartment and also separate respective functional areas in the passing platform 38. The partition wall has a structure of wood composite board. An outermost layer of the wood composite board is a layer of decorative board, and the decorative board has a pattern of wood grain to improve the overall aesthetic effect of the partition wall. In order to make passengers getting on and off the vehicle conveniently, a handrail is mounted on at least one partition wall on one side at the entrance of the passenger door 3. Preferably, one handrail is mounted on the partition walls on both sides to facilitate passengers getting on and off the vehicle, and to ensure the safety of passengers getting on and off the vehicle.

In order to make passengers get on and off the vehicle easily, in the present embodiment, at least one partition wall on one side at the entrance of the passenger door 3 is provided with a number light and a decorative light. The number light helps the passenger after getting on to confirm whether they get on the correct compartment. The decorative light not only can play the role of lighting, but also can play the role of decoration, thereby improving the overall aesthetic effect of the passing platform 38. Structures of the decorative light and the number light are the same as those described in the second embodiment. A ceiling light (not shown) may further be mounted on a top of the passing platform 38 to further enhance the lighting and decoration effects.

A wash basin 41, a lavatory 42, a leisure area 43, a power distribution cabinet 44, and the like are arranged around the circular passing platform 38. The wash basin 41 is mounted on one side at the entrance of one of the passenger doors 3, that is, the wash basin 41 is mounted in a space between the passenger door 3 and a compartment end door 13 of the own compartment, which amounts to omitting a washroom separately arranged in the existing vehicle, making full use of a dead space between the entrance of the passenger door 3 and the lateral partition wall. The wash basin 41 includes a basin and a faucet, downcomers and the like are concealed in a cabinet surrounded by the partition wall 14 under the wash basin 41, and a shelf is fixedly mounted above the wash basin 41 for the passenger to place towels and the like. A mirror and one or two downlights are mounted on the partition wall above the shelf for passengers to use. As for business-class compartments, a wash sink may be omitted due to space restriction.

A lavatory 42 is arranged on one side of the aisle 40. The lavatory 42 is opposite to the wash basin 41, and the two are respectively arranged on two sides of the passenger door 3. The lavatory 42 is provided with a toilet bowl, a sink, etc. An independent space may be separated from the lavatory 42 to serve as a simple shower room for passengers to use. A sign light is arranged on a partition wall of the lavatory 42.

In the present embodiment, an area on a side of the other passenger door 3, that is, on the other side of the aisle 40 opposite to the lavatory 42, serves as a leisure area 43 for passengers to temporarily relax. Leisure equipment such as leisure sofas are arranged in the leisure area 43, and a simple coffee table for passengers to use may be placed next to the leisure sofa.

The power distribution cabinet 44 is arranged in an area which is opposite to the leisure area 43 and at the other side of the passenger door 3. The power distribution cabinet 44 and the wash basin 41 are respectively arranged on the two sides of the compartment end door 13. Similar to the wash basin 41, the power distribution cabinet makes full use of the dead space between the entrance of the passenger door 3 and the lateral partition wall of the passing platform.

According to the present application, the wash basin 41, the lavatory 42, the leisure area 43, and the power distribution cabinet 44 are designed to be arranged around the circular passing platform 38, so that the space structure of the entire passing platform 38 is very compact. Through a reasonable layout of the respective facilities around the passing platform 38, the space utilization of an end portion of the vehicle is greatly improved, which is easy for the passengers to use, provides the passengers with more functions, and correspondingly increases a movement area of the passengers, thereby improving the functionality of the vehicle and the riding comfort of the passengers, and providing passengers with better service. The design is especially suitable for long-distance operation vehicles.

The Fifth Embodiment

As shown in FIGS. 8 to 11, in the present embodiment, the double-decker vehicle further includes a double-decker head compartment 69. The upper deck of the head compartment 69 is a sightseeing compartment 48 provided with a sightseeing area. The sightseeing area is formed by a portion higher than the cab 68. The lower compartment is a bar compartment 49.

Figure 10:
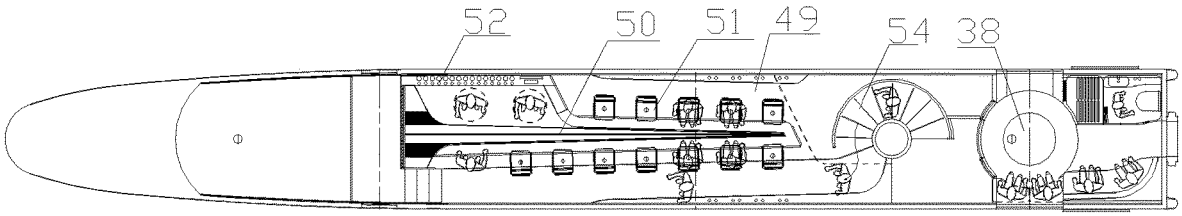
FIG. 10 is a schematic plan view of a bar compartment according to the present application.

As shown in FIG. 10, bar tables 50, bar chairs 51 and a wine cabinet 52 are mounted in the bar compartment 49. The bar tables 50 are arranged in a row in the middle of the bar compartment 49. Multiple bar chairs 51 are respectively arranged on two sides of the bar tables 50. The wine cabinet 52 is arranged in a corner of the bar compartment 49. Side windows 53 are arranged on the two side walls of the bar compartment 49, so that passengers can entertain and relax in the bar compartment 49.

A circular staircase 54 is arranged between the upper sightseeing compartment 48 and the lower bar compartment 49. The passing platform 38 connected to a head compartment door 55 is arranged at an end of the head compartment. The head compartment door 55 and the passenger door 3 of the middle compartment are on a same deck. After entering the vehicle from the head compartment door 55 or entering from another adjacent middle compartment, the passenger walks through the passing platform 38, then walks upwardly along the staircase 54 to enter the sightseeing compartment 48, or walks downwardly along the staircase 54 to enter the bar compartment 49.

Figure 8:
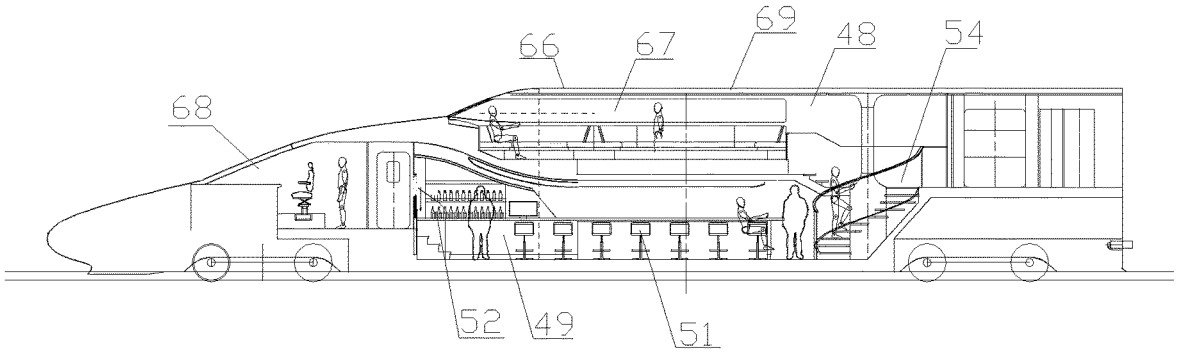
FIG. 8 is a schematic diagram showing the structure of a cab and a head compartment according to the present application.
Figure 9:
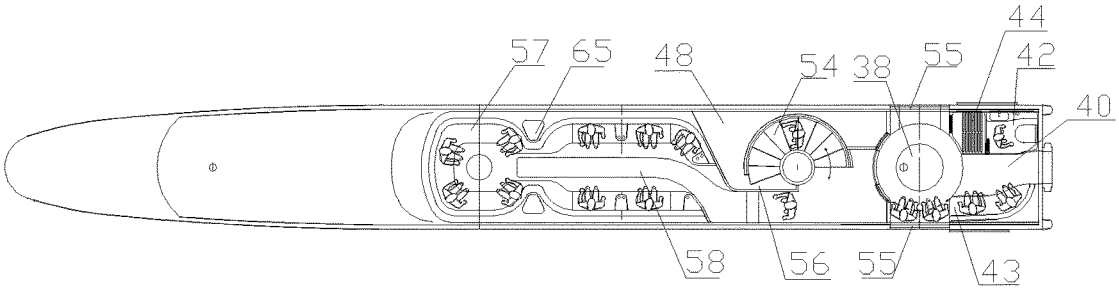
FIG. 9 is a schematic plan view of a sightseeing compartment according to the present application.

As shown in FIG. 8 and FIG. 9, the sightseeing compartment 48 has a portion which is higher than the cab, and a sightseeing window 67 is arranged on the higher portion of the vehicle body. The entire sightseeing compartment 48 may be higher than the cab, but in order to lower a center of gravity of the vehicle as much as possible and to reduce air resistance during the traveling of the vehicle body, it is preferable to arrange only the upper half of the sightseeing compartment 48 above the cab, which reduces the height of the vehicle while satisfying the sightseeing function.

The sightseeing window 67 is arranged on the portion of vehicle body of the sightseeing compartment 48 higher than the cab. The sightseeing window 67 may be composed of glass or other transparent material. In the present embodiment, the sightseeing window 67 preferably has a hollow structure of double-layer glass, which can improve the visual effect and ensure the structural strength of the entire vehicle body.

In the present embodiment, it is preferable that a front end portion and two side portions of the sightseeing compartment 48 are each provided with the sightseeing window 67. More preferably, the sightseeing window 67 has a continuous annular structure from the front end portion to the two sides of the sightseeing compartment 48. When sitting in the sightseeing compartment 48, passengers can view the landscape outside the vehicle through the annular sightseeing window 67 on three sides, which provides a full-vision viewing experience, and improves the functionality and comfortableness of the vehicle.

In the present embodiment, the sightseeing window 67 extends upwardly from the position higher than the cab to the roof panel. For the entire compartment, the sightseeing window 67 is mounted at a side-roof position of the side wall of the vehicle body connecting with the roof. The sightseeing window 67 conforms with the vehicle in shape in a height direction, and has an arc shape, so that the side wall and a front end wall of the vehicle body higher than the cab are all the sightseeing windows 67, thereby increasing the height and area of the sightseeing window 67, ensuring the viewing effect of passengers, and improving the overall appearance of the entire vehicle.

Multiple openings for mounting the sightseeing windows 67 are opened in the front end portion and the two side portions of the sightseeing compartment 48 higher than the cab. The window glasses are fixed to window frames at the openings by adhesive. The window frames are fixed to the body frame by bolts. In this embodiment, it is preferable to open one opening at the front end portion and two or three openings at each side portion of the vehicle body, so that the width of the sightseeing window 67 in a horizontal direction can be increased, and the area of the sightseeing window 67 can be increased, which can ensure the viewing effect of the passengers and ensure the structural strength of the entire vehicle body.

In order to further improve the overall appearance of the vehicle, a layer of transparent material (not shown) is further coated on an outer surface of the sightseeing window 67, that is, on the front end portion and the two side portions of the sightseeing compartment 48 higher than the cab, so that in view of appearance, all the two side portions and the front end portion of the vehicle body higher than the cab are transparent materials with good appearance.

Decorative lights (not shown) may be mounted at an upper edge and a lower edge of the sightseeing window 67, or the like. The decorative light may be a strip-shaped LED light, which not only serves as illumination but also serves as decoration, thereby improving the overall aesthetics of the sightseeing compartment 48.

In order to reduce the air resistance of the vehicle body during traveling, a transition between a housing of the cab and a housing of the portion of the sightseeing compartment 48 higher than the cab is streamlined by bevels or arc-shaped surfaces, or as shown in FIG. 8, the transition is in a stepped structure. An arc-shaped surface transition is implemented at a stepped connection between the cab and the sightseeing compartment 48, and a front end portion of the housing of higher portion of the sightseeing compartment 48 also has a structure of arc-shaped surface in the horizontal direction. In addition, a U-shaped recessed portion (not shown) of the vehicle head is arranged along the front end portion and the two side portions of the vehicle head, and a main function thereof is to guide air flow. By a reasonable design of the overall shape of the vehicle head, the strength of the vehicle head can be ensured and the air resistance can be reduced during high-speed traveling, while increasing the height of the vehicle body and increasing the area of the window glass, so that the vehicle has a good aerodynamic performance. A cowcatcher at the front end portion of the vehicle head may has a structure protruding forward along an arc-shaped outline of the vehicle head, which is more advantageous for eliminating large foreign objects and ensures traveling safety.

A downwardly recessed structure is arranged at a junction of the sightseeing compartment 48 higher than the cab, that is, at the lower edge of the sightseeing window 67. The downwardly recessed structure is annularly arranged along the lower edge of the sightseeing window 67, of which the main function is to guide the airflow to further reduce the air resistance during traveling, so that the vehicle has good aerodynamic performance, thereby ensuring a high travelling speed and stability of the vehicle.

Since the sightseeing window 67 is arranged in an annular shape, a sightseeing seat 57 arranged in an annular shape is arranged in the sightseeing compartment 48 along the annular sightseeing window 67 to improve the viewing effect and the riding comfort during viewing. The sightseeing seat 57 is arranged along the sightseeing window 67, and a middle portion surrounded by the annular sightseeing seat 57 is the aisle 58 of the sightseeing compartment 48, so that the passenger can obtain a full-vision viewing experience while sitting on the sightseeing seat 57, and view the scenery along the way with a great view and riding space, thereby obtaining a more perfect view outside the vehicle.

Figure 11:
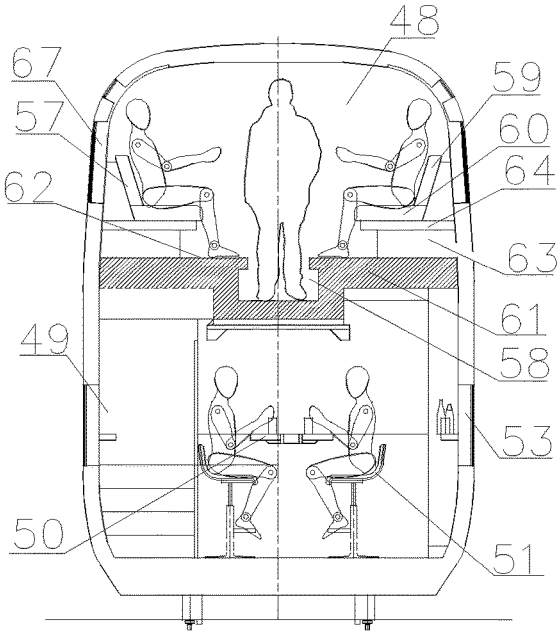
FIG. 11 is a cross-sectional view of the head compartment according to the present application.

As shown in FIG. 9 and FIG. 11, the annular sightseeing seat 57 includes a backrest 59, a seat cushion 60, and a base 61. The backrest 59 and the seat cushion 60 are composed of a middle layer of sponge and an outer layer of decorative cloth. The seat cushion 60 is mounted on the base 61. The backrest 59, the seat cushion 60 and the base 61 are arranged in an annular shape along the front end portion and the two side portions of the sightseeing compartment 48.

In the present embodiment, the base 61 has a step structure to increase the height of the sightseeing seat 57. The number of steps and the overall height of the base 61 ensure that the sight line of average people is higher than the sightseeing window 67 of the sightseeing compartment after sitting on the sightseeing seat 57. Therefore, the base 61 preferably has a two-step structure. The seat cushion 60 is mounted on a second step of the upper layer, and a first step of the lower layer protrudes outwardly as a footrest 62, which is not only simple in overall structure but also greatly improves the riding comfort of the passengers. The sightseeing seat 57 is simple in structure, elegant in appearance, and makes full use of the limited space in the sightseeing compartment 48.

Each step of the base 61 is composed of a vertical support plate 63 and a horizontal face plate 64, and decorative lights (not shown) are mounted on an edge of the face plate 64 of each step. The decorative light may be a strip-shaped LED light, which not only serves as illumination but also serves as decoration, thereby improving the overall aesthetics of the sightseeing compartment 1.

The sightseeing seat 57 includes at least one shelving table 65 for placing articles. For convenience of use, two shelving tables 65 are symmetrically arranged on the sightseeing seat 57 on both sides. A portion integrated with the backrest 59 protrudes forwardly to form the shelving table 65, such that the sightseeing seat 57 is recessed inwardly from both sides. An upper surface of the lay-up table 65 is provided with a decorative panel of metal texture for placing wineglasses, water cups, etc., which is not only easy to use but also improves the overall aesthetics of the sightseeing compartment 48.

In the present embodiment, a sunroof 66 for sightseeing is provided on the roof panel of the sightseeing compartment 48. The passengers on the sightseeing seat 57 can view the scenery outside the vehicle through the surrounding sightseeing window 67, and can also watch the sky from the sunroof 66 on the roof. An opening for mounting the sunroof 66 is opened in the roof panel of the vehicle body, and the sunroof glass is fixed to a window frame at the opening by adhesive. The window frame is fixed to the body frame by bolts.

A displayer for displaying information of the vehicle is mounted at the staircase 54. A partition is provided at an entrance of the staircase 54 of the sightseeing compartment 48, and a partition 56 is provided at the entrance of the staircase to the lower bar area. An embedded rack for placing newspapers, magazines, etc. is arranged on the partition 56, which is convenient for passengers to use.

The Sixth Embodiment

Figure 12:
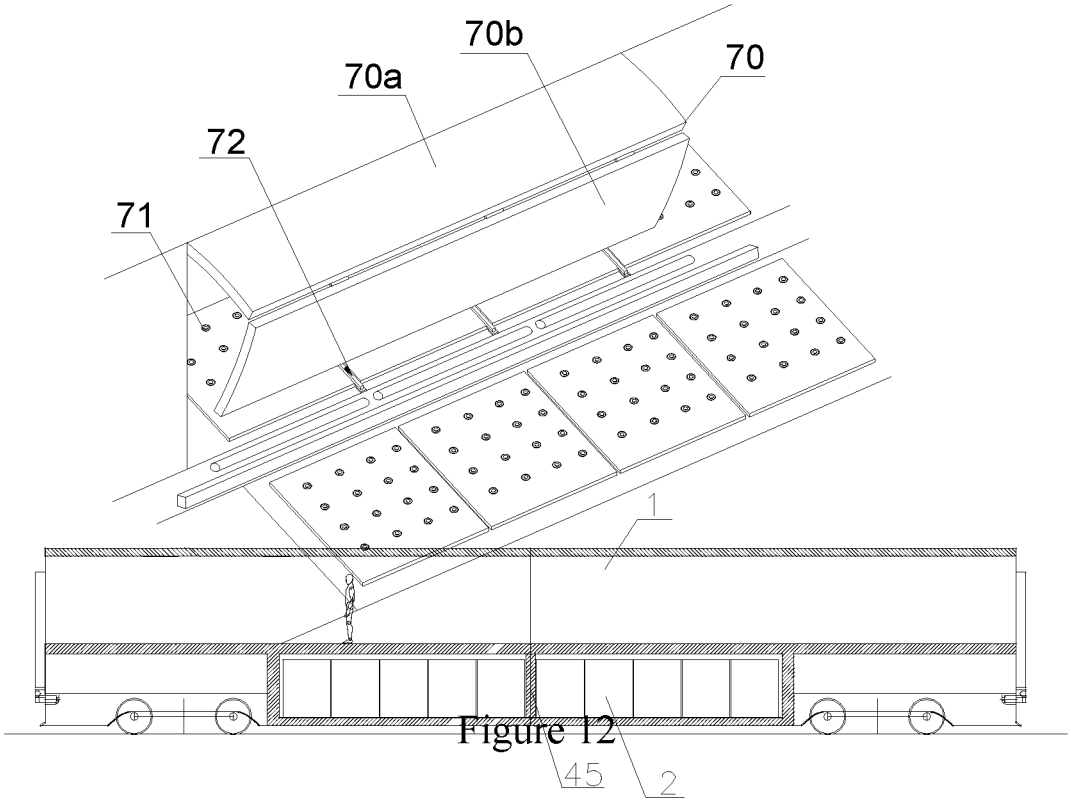
FIG. 12 is a schematic view showing the structure of a cargo compartment according to the present application.

As shown in FIG. 1 and FIG. 12, in the present embodiment, the lower cargo compartment 2 is a through structure from one head compartment on one side to the other head compartment on the other side, and is divided into a plurality of sections of independent space in the middle by vertical support structures 45, parts of which are equipment compartments, other parts are cargo holds. The equipment compartment is used for placing vehicle equipment such as an air conditioning, and the cargo hold is used to load the cargo. The equipment compartment is located above bogies, and the cargo hold is located halfway between two bogies.

The support structure 45 preferably adopts a metal frame structure to ensure the overall structural strength of the support structure 45. The support structure 45 is arranged in the width direction of the vehicle body. Except for supporting the upper passenger compartment 1, the support structure can also divide the cargo hold of the cargo compartment 2 into a plurality of different functional sections to facilitate separate placement of different types of cargoes, which facilitates the identification and handling of the cargoes.

One skirt plate is mounted on each of the two sides of the equipment compartment of the cargo compartment **2*b* in the width direction of the vehicle body, and a folding door 70 is arranged on each of the two side of the cargo hold in the width direction of the vehicle body. The folding door 70 includes an upper page 70*a* and a lower page 70*b*. The upper page 70*a* is hinged to the lower page 70*b*. When the folding door 70 is opened, the upper page 70*a* and the lower page 70*b* are folded and overlapped to open the door. With the arrangement of the folding door 70, a radius of opening door can effectively be reduced, thereby reducing the required space, and facilitating the loading and unloading of the cargoes or the containers 10**.

A top of the upper page **70*a* of the folding door 70 is hinged to the frame of the vehicle body, and a door support mechanism 46 for supporting the folding door 70 is mounted between the folding door 70 and the support structure 45. The door support mechanism 46 is a compartment door support rod arranged between the upper page 70*a* and the support structure 45, and the compartment door support rod is an elastic support structure. The compartment door support rod includes a cylinder and a strut, and one end of the cylinder is hinged to the support structure 45, a power end of the cylinder is fixed to one end of the strut, and the other end of the strut is fixed to the upper page. When the door is opened, the cylinder drives the strut to extend, the upper page 70***a* is turned over and accordingly the lower page 70*b* is turned over and is folded onto the upper page 70*a*. When the door is closed, the strut retracts, the upper page 70*a* is turned over, and accordingly the lower page 70*b* is turned over and forms the door together with the upper page 70*a*.

A cargo hold floor is arranged in the cargo compartment 2. The cargo hold floor is divided into multiple rectangular blocks, and each block of the cargo hold floor is provided with multiple ball bearings 71. The ball bearing 71 is used for moving the cargoes or the containers in the cargo hold, which enables free movement of the cargoes and the containers and facilitates automated cargo handling.

A lift positioning structure 72 is provided in the cargo hold, and the lift positioning structure 72 is used for fixing and positioning the cargoes or the containers. The lift positioning structure 72 is arranged between two adjacent rectangular blocks of the cargo compartment floor, and a cross-sectional shape of the lift positioning structure 72 is an inverted-T shape. The lift positioning structure 72 engages with a bottom of the freight container 10. When the container 10 is loaded in place, the lift positioning structure 72 is raised to fix the container 10 to prevent it from shaking during the traveling of the vehicle, thereby avoiding damage of the structure of the vehicle and the cargoes inside.

When the cargo arriving at a station needs to be handled, the folding door 70 is opened upward, a robot automatically identifies the containers 10 that need to be unloaded, and the robot pushes the containers 10 in the cargo compartment 2 out of the vehicle in the width direction of the vehicle. The containers 10 are pushed into a cargo-unloading passage 8, and are conveyed out of the platform through the cargo-unloading passage 8, thus completing the cargo unloading. Alternatively, while the robot pushes the containers 10 into the vehicle, the containers 10 entering the cargo compartment 2 of the vehicle and crowd the original containers 10 in the compartment out of the cargo compartment 2 to the cargo-unloading passage 8. The cargo is conveyed out of the platform by the cargo-unloading passage 8, thus completing the unloading of the cargo. The automatic loading and unloading is realized, and the loading and unloading can be carried out at the same time, which improves the loading and unloading efficiency. Moreover, the loading and unloading method of pushing-in and pushing-out is efficient and takes up small space.

The support structure 45 has a hollow bracket structure, and includes a frame composed of two transverse racks and two longitudinal racks, and reinforcing racks fixed in the frame and fixed to the transverse racks and/or the longitudinal racks.

The two transverse racks are respectively fixed on the top and bottom of the cargo compartment, and the two longitudinal racks are respectively fixed on the two sides of the cargo compartment. The two transverse racks and the two longitudinal racks form a square-shaped frame. The reinforcing racks are arranged in the frame. The reinforcing racks include transverse reinforcing racks and oblique reinforcing racks. The transverse reinforcing racks are arranged between two transverse racks, and the oblique reinforcing racks are respectively fixed between the transverse reinforcing rack and the transverse rack and fixed between the transverse reinforcing rack and the longitudinal rack. Through the above structural arrangement, the entire support structure 45 has sufficient support strength to meet the safety requirements of the cargo hold. In order to reduce the weight of the cargo compartment, in the present embodiment, the transverse racks, the longitudinal racks and the reinforcing racks are hollow racks.

Seventh Embodiment

The difference from the above embodiments is that a certain area is separated out in the passenger compartment 1, such as an area at an end of the compartment, as an auxiliary cargo area for storing cargo. In the cargo compartment 2, a certain area is similarly separated out as an auxiliary passenger area for passenger to use to further improve the functionality of the vehicle.

Based on the above description, similar technical solutions can be derived with reference to the content of solutions provided in the drawings. However, any simple changes, equivalent variations and modifications made to the above embodiments according to the technical contents of the present application, without departing from the content of the technical solutions of the present application, are all deemed to fall in the scope of the technical solutions of the present application.

The invention claimed is:

1. A double-decker rail vehicle, comprising:

a passenger compartment for passengers to ride and a cargo compartment for placing cargoes, wherein the passenger compartment is provided with passenger doors for passengers to get on and off and the cargo compartment is provided with cargo doors for loading and unloading cargoes, wherein the cargo compartment has a through cargo space from one head compartment on one side to the other head compartment on the other side, and support structures are provided in the cargo space, wherein the cargo space is divided into a plurality of sections by the support structures, parts of the sections are equipment compartments, and other parts are cargo holds, a folding door is arranged on each of the two side of each cargo hold in the width direction of the vehicle body, the folding door comprises an upper page and a lower page, and the upper page is hinged to the lower page, when the folding door is opened, the upper page and the lower page are folded and overlapped to open the door, wherein a top of the upper page of the folding door is hinged to the frame of the vehicle body, and a door support mechanism for supporting the folding door is mounted between the folding door and the support structure, the door support mechanism is a compartment door support rod arranged between the upper page and the support structure, and the compartment door support rod is an elastic support structure, the compartment door support rod includes a cylinder and a strut, and one end of the cylinder is hinged to the support structure, a power end of the cylinder is fixed to one end of the strut, and the other end of the strut is fixed to the upper page, when the door is opened, the cylinder drives the strut to extend, the upper page is turned over and accordingly the lower page is turned over and is folded onto the upper page, when the door is closed, the strut retracts, the upper page is turned over, and accordingly the lower page is turned over and forms the door together with the upper page.

2. The double-decker rail vehicle according to claim 1, wherein the upper compartment is the passenger compartment, and the lower compartment is the cargo compartment.

3. The double-decker rail vehicle according to claim 1, wherein the passenger compartment is provided with two rows of seat units arranged in a length direction of a vehicle body, two adjacent units are staggered and overlapped in the length direction of the vehicle body, the seat unit comprises a seat, and the seat is tilted toward a side wall on a side where the seat is located.

4. The double-decker rail vehicle according to claim 3, wherein each of the seat units is partitioned by a seat partition wall, the seat partition wall is composed of a transverse partition wall and a longitudinal partition wall, the transverse partition wall is S-shaped, and the seat extends in a space where an outer side of the transverse partition wall of the present seat unit is outwardly recessed and extends in a space where an inner side of the transverse partition wall of the front seat unit is inwardly recessed.

5. The double-decker rail vehicle according to claim 4, wherein a partition wall door is arranged on the longitudinal partition wall, the partition wall door is a sliding door, the longitudinal partition wall has a hollow structure, and the partition wall door in an open state is concealed inside the longitudinal partition wall.

6. The double-decker rail vehicle according to claim 3, wherein each of the seat units is provided with the seat, a footrest, a table and a functional chair;

the seat comprises a backrest, a seat cushion and a movement mechanism, the movement mechanism drives the backrest and the seat cushion to move, so that the seat can be switched between a sitting position, a lying position and any reclining position;

the footrest is arranged exactly in front of the seat, when the seat is in the lying position, the footrest, the seat cushion and the backrest together form a horizontal sleeper, and the table and the functional chair are arranged on a side portion of the seat facing the side wall.

7. The double-decker rail vehicle according to claim 3, wherein a set of windows are arranged on the vehicle body corresponding to each of the seat units.

8. The double-decker rail vehicle according to claim 1, wherein the passenger compartment comprises a plurality of compartments partitioned by compartment partition walls, each compartment partition wall is provided with a compartment door, and each of the compartments is provided with a rest area and a lavatory.

9. The double-decker rail vehicle according to claim 8, wherein a sitting and lying dual-purpose device is mounted in the rest area, the lavatory is separated from the rest area by a partition, and a lavatory door is mounted on the partition.

10. The double-decker rail vehicle according to claim 9, wherein the sitting and lying dual-purpose device at least comprises a set of sofa capable of shifting between a sitting position and a lying position and sofa stool, and the sofa in the lying position is combined with the sofa stool to form a horizontal bed.

11. The double-decker rail vehicle according to claim 8, wherein the compartment partition wall immediately adjacent to an aisle of the compartment has a wavy structure composed of a plurality of arc-shaped partition walls.

12. The double-decker rail vehicle according to claim 8, wherein a first window is arranged on the side wall of the vehicle body corresponding to the rest area, and a second window is arranged on the side wall of the vehicle body corresponding to the lavatory.

13. The double-decker rail vehicle according to claim 1, wherein cargo doors are arranged on both sides of the cargo hold.

14. The double-decker rail vehicle according to claim 1, wherein each of the support structures has a hollow bracket structure.

15. The double-decker rail vehicle according to claim 13, wherein a cargo hold floor is arranged in each of the cargo holds, and the cargo hold floor is provided with a plurality of rows of ball bearings for moving the cargoes in the cargo holds.

16. The double-decker rail vehicle according to claim 1, wherein a passenger platform and a freight platform are arranged corresponding to the passenger compartment and the cargo compartment.

* * * * *